US006309177B1

(12) United States Patent
Swiderski et al.

(10) Patent No.: US 6,309,177 B1
(45) **Date of Patent: *Oct. 30, 2001**

(54) CONCENTRICITY RING

(75) Inventors: Joseph John Swiderski, Dundas; William Donald Moase, Mississauga, both of (CA)

(73) Assignee: Pratt & Whitney Canada Corp., Longueuil (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,461

(22) Filed: Jun. 8, 1999

(51) Int. Cl.[7] ..... F01D 11/14

(52) U.S. Cl. ..... 415/173.2; 415/173.1; 60/39.31; 29/464; 29/889.1; 29/889.2; 29/889.21

(58) Field of Search ..... 415/126, 128, 415/133, 173.1, 173.2, 174.1; 29/464, 889.1, 889.2, 889.21; 60/39.31

(56) References Cited

U.S. PATENT DOCUMENTS

| | | | |
|---|---|---|---|
| 4,187,579 | 2/1980 | Gensicke . | |
| 4,222,708 | 9/1980 | Davison . | |
| 4,343,592 | 8/1982 | May . | |
| 4,548,546 | 10/1985 | Lardellier . | |
| 4,723,075 | 2/1988 | German . | |
| 4,786,232 | 11/1988 | Davis et al. . | |
| 5,193,377 | 3/1993 | Sendzimir et al. . | |
| 5,400,133 | 3/1995 | Hinton et al. . | |
| 5,409,656 | 4/1995 | Naruse et al. . | |
| 5,562,408 * | 10/1996 | Proctor et al. | 415/173.1 |
| 5,713,671 | 2/1998 | Egeter . | |

* cited by examiner

*Primary Examiner*—Christopher Verdier
(74) *Attorney, Agent, or Firm*—Jeffrey W. Astle

(57) ABSTRACT

There is provided a method of assembling a gas turbine engine using a concentricity ring to compensate for assembly tolerances. The blade tips of the gas turbine during turbine rotation define a tip surface of rotation concentric the shaft axis. Due to cumulative tolerances in part manufacture and assembly, the shaft axis is invariably radially eccentric the engine axis at the axial position of the turbine an assembly eccentricity within the range between zero and a predetermined allowable assembly tolerance. The method relates to the step of positioning a concentricity ring with: an outer cylindrical surface engaging the internal cylindrical surface of the engine housing; and an inner cylindrical surface engaging the external cylindrical surface of the turbine shroud, the outer and inner cylindrical surfaces of the concentricity ring being eccentric a ring eccentricity within the range between zero and said predetermined allowable assembly tolerance to rectify the assembly eccentricity of the moving and static components in a simple expeditious manner.

7 Claims, 4 Drawing Sheets

CONCENTRICITY RING

TECHNICAL FIELD

The invention is directed to a method of assembling a gas turbine engine using a concentricity ring between mating components to compensate for cumulative assembly tolerances, and in particular to achieve an extremely close tolerance which is essential in assembling high pressure gas turbines within a mating turbine shroud to minimize the blade tip gap and optimize engine performance.

BACKGROUND OF THE ART

In the assembling of a gas turbine engine several interconnecting components are assembled together, all of which are machined with high precision although within a specified dimensional tolerance. The cumulative effect of these tolerances in assemblies of multiple parts must be accommodated especially when extremely high precision in assembly is required.

One example of such precision is in the assembly of high-pressure turbines and their associated turbine shrouds immediately downstream of a combuster in the gas turbine engine. It has been estimated that the tip clearance, between the tips of turbine blades and the turbine shroud surrounding the rotating blades, is so critical to engine performance that each 0.001-inch of excess tip gap results in approximately a 0.25% decrease in engine performance. As a result, extreme care is taken in ensuring that high-pressure turbine blades are accurately assembled together with their associated turbine shrouds.

In the prior art the method of assembling high-pressure turbines and their shrouds involves assembling the engine including the combuster and high-pressure turbine shaft within acceptable assembly tolerances. The high-pressure turbines are then mounted to the high-pressure turbine shaft and invariably the rotational axis of the turbine is somewhat eccentric of the longitudinal axis of the combuster due to accumulation of machining tolerances.

In order to accurately fit the turbine shroud about the blades of the turbine with minimal tip gap, it is common practice to custom grind the internal surface of each shroud to precisely match the eccentricity and outside diameter of the turbine blades in operation.

As will be appreciated, the withdrawal of the turbine shroud from assembly operations and precision grinding involve significant delay in the assembly operation as well as high costs as a result of the skilled labour involved in the process. In effect, while the custom grinding operation is being carried out on the turbine shrouds, the assembly operation is halted imposing significant manufacturing difficulties due to space and scheduling commitments.

In general, all machinery assembly operations can benefit from the use of standardized components rather than custom fitting each component as required. Standardization of components and simplification of the assembly process, inevitably will reduce costs and increase the speed of production.

It is an object of the present invention, therefore, to eliminate the custom grinding of turbine shrouds and permit the standardization of turbine shroud manufacture regardless of the eccentricity produced in assembly of turbines used in gas turbine engines.

It is a further object of the invention to provide a simple means by which eccentricity of turbines can be accommodated without custom grinding or removal of components from the flow of assembly and production.

It is a further object of the invention to enable eccentricity of the assembled turbines to be accommodated without significant alteration to the prior art structure of gas turbine engine components. Ideally, only minimal modification is desirable.

DISCLOSURE OF THE INVENTION

The invention provides a method of assembling a gas turbine engine using an eccentic concentricity ring to compensate for assembly tolerances.

A typical gas turbine engine has a longitudinal engine axis with at least one turbine disposed on a shaft assembly at a predetermined axial position for rotation about a longitudinal shaft axis. The turbine includes a hub with a circumferentially spaced apart array of turbine blades each having a radially outward blade tip. The blade tips during turbine rotation define a tip surface of rotation concentric the shaft axis.

Due to cumulative tolerances in part manufacture and assembly, the shaft axis is invariably radially eccentric the engine axis at the axial position of the turbine an assembly eccentricity within the range between zero and a predetermined allowable assembly tolerance. The engine is assembled progressively to the stage where the static outer engine housing assembly has an engine housing flange with a cylindrical internal surface concentric the engine axis, and a static turbine shroud having a shroud flange with an external cylindrical surface is to be removably mounted to the engine housing flange with an internal turbine shroud surface of rotation matching the blade tip surface of rotation.

The invention relates to the step of positioning a concentricity ring with: an outer cylindrical surface engaging the internal cylindrical surface of the engine housing flange; and an inner cylindrical surface engaging the external cylindrical surface of the turbine shroud flange, the outer and inner cylindrical surfaces of the concentricity ring being eccentric a ring eccentricity within the range between zero and said predetermined allowable assembly tolerance to rectify the assembly eccentricity in a simple expeditious manner.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
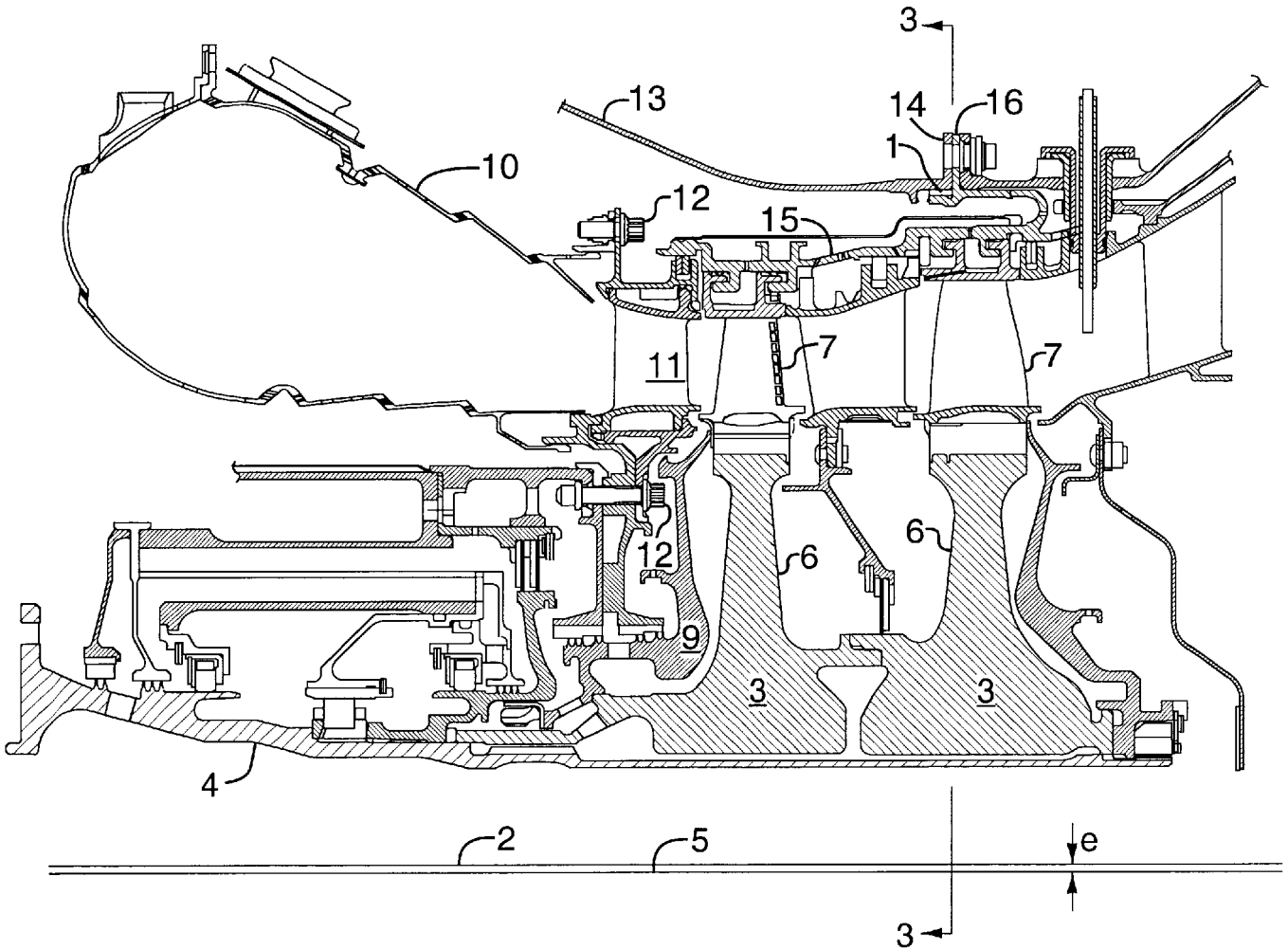
FIG. 1 is a partial one half-axial sectional view through the combuster and two high-pressure turbines of a gas turbine engine.

With reference to FIG. 1, the invention is directed to a method of assembling a gas turbine engine using a concentricity ring 1 between mating cylindrical components to compensate for cumulative assembly tolerances and machining tolerances of the assembled engine components. In particular the invention is directed to achieving the extremely close tolerance essential for assembling high pressure gas turbines within a mating turbine shroud to minimize the blade tip gap and optimize engine performance. The general construction of a gas turbine engine will be considered part of the common general knowledge to those skilled in the art and therefore will be briefly outlined in this description.

Figure 3:
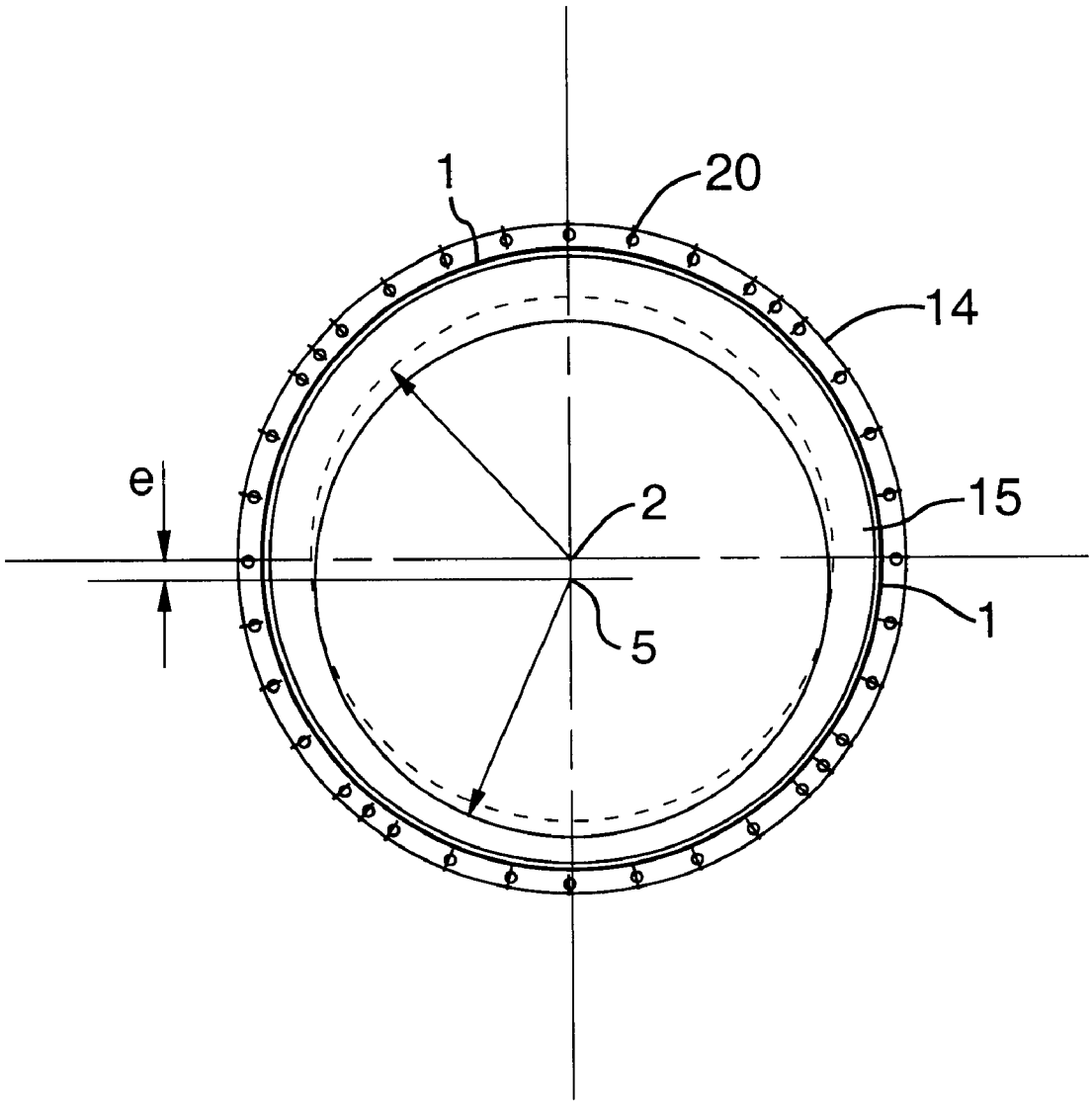
FIG. 3 is a radial cross-sectional view along line 3—3 of FIG. 1 showing an engine housing flange with turbine shroud mounted thereto including a concentricity ring to adjust for eccentricity of the turbines on the shaft axis relative to the engine axis.
Figure 4:
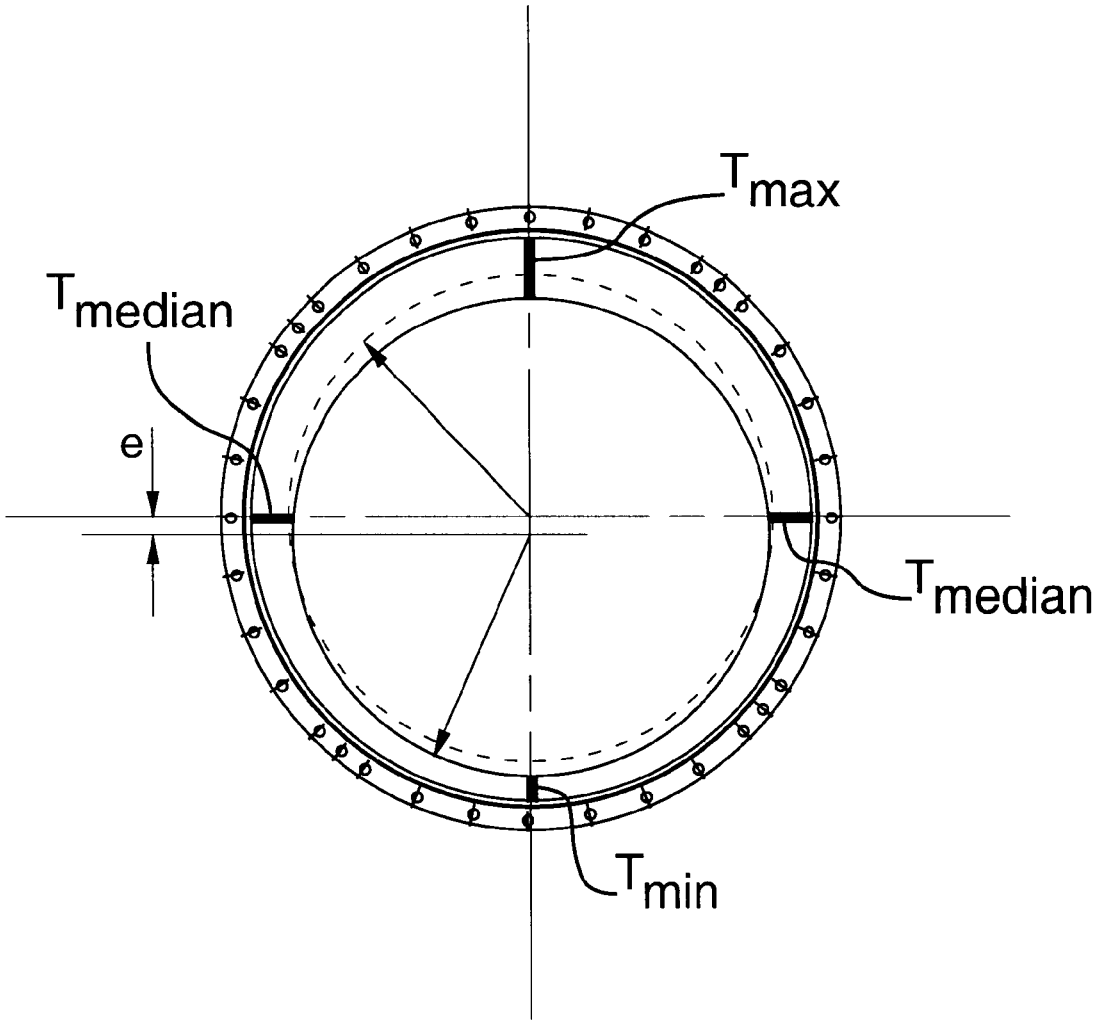
FIG. 4 is a radial cross-sectional view similar to FIG. 3 with markings indicating maximum ring thickness ($T_{max}$), minimum ring thickness ($T_{min}$) and medium ring thickness ($T_{median}$).

As shown in FIG. 1, a gas turbine engine includes a longitudinal engine axis. In the embodiment illustrated, the engine includes two high-pressure turbines 3 disposed in a shaft assembly 4 at a pre-determined axial position for rotation about a longitudinal shaft axis 5. The shaft axis 5 is shown in FIGS. 1 and 3 as eccentric from the engine axis 2 by a dimension "e". It will be understood that for clarity the drawing is not to scale and that in reality the eccentricity dimension "e" is in the order of less than $5/1000^{th}$ of an inch which would be imperceptible in the scale of the drawing attached.

It will also be understood that although the description relates to assembly of a high-pressure turbine, the invention is equally applicable to any machine or turbine assembly where eccentricity is to be compensated for. A high pressure turbine is merely chosen for this example since it is an area of the gas turbine engine in which extremely close tolerances are absolutely essential and where excessive blade tip gap can result in extremely high engine efficiency losses.

Figure 2:
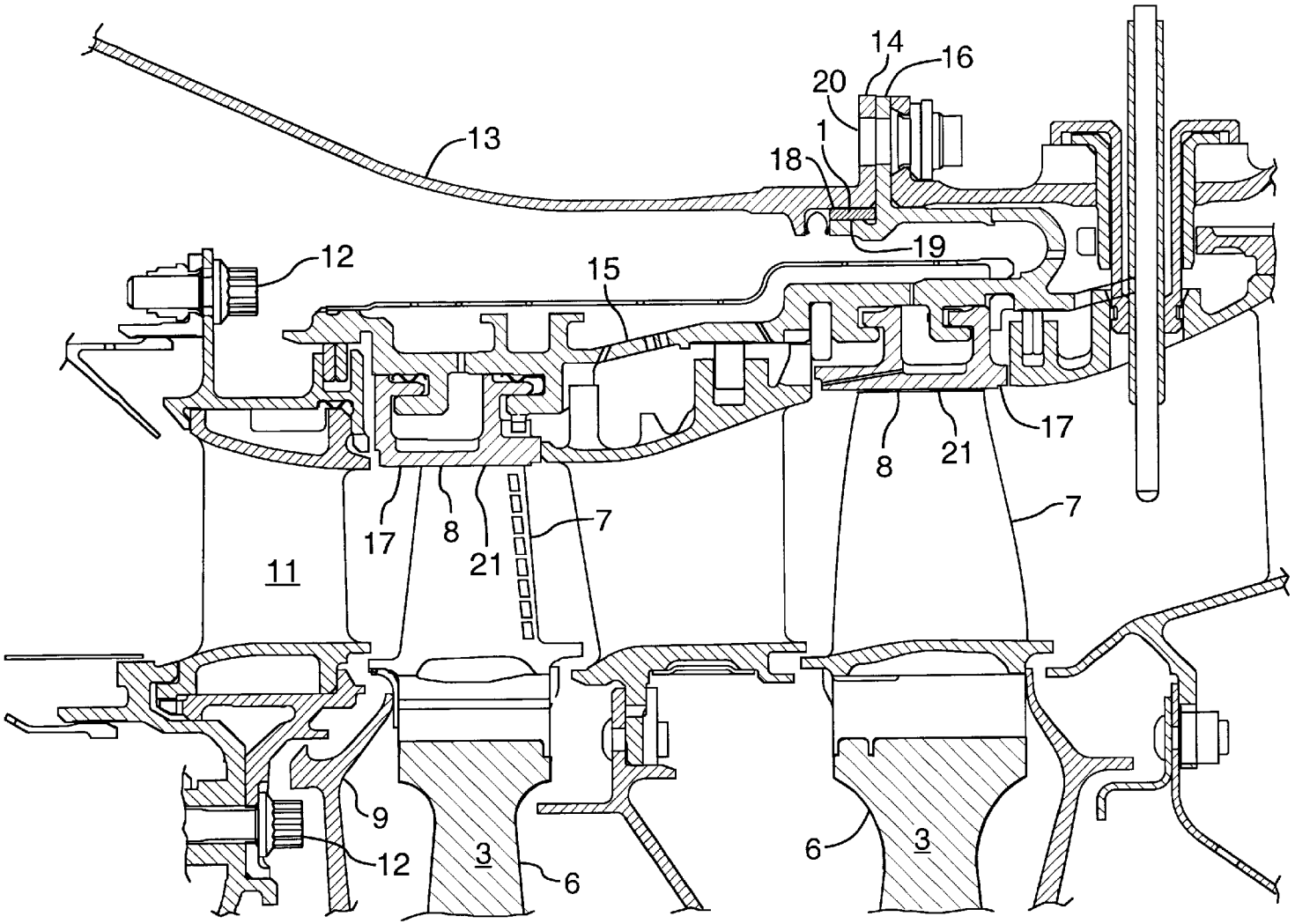
FIG. 2 is a like axial cross-section showing the details of the turbine shroud and its engagement with the engine housing.

Referring jointly to FIGS. 1 and 2, a typical gas turbine engine includes turbines 3 which have a central hub 6 and a circumferentially spaced apart array of turbine blades 7 each having a radially outward blade tip 8. It will be apparent that during turbine rotation the blade tips 8 define a tip surface of rotation which is concentric to the shaft axis 5. Each blade 7 will be machined within the appropriate machining tolerance however; each individual blade tip surface will be slightly different. The rotating blade tips 8 therefore define a tip surface of rotation, which represents the radially outward most extent of any blade 7 within the array. Of course, ideally all blade tips 8 are identical and define a generally frustoconical tip surface of rotation concentric to the shaft axis 5.

The shaft axis 5 is radially eccentric the engine axis 2 at the axial position of the turbines 3 by an assembly eccentricity "e" which is within the range between 0 and a pre-determined allowable assembly tolerance. For instance, in a relatively small diameter engine, the turbine diameter will be in the range of 20 to 30 inches and the eccentricity allowable on assembly will be in the order 5 to $10/1000$th of an inch.

In assembling the gas turbine engine illustrated in FIGS. 2 and 3, the progressions of assembly is generally from left to right as shown. The stage of assembly relevant to the present embodiment of the invention is reached when the shaft assembly 4 is completed absent the high-pressure turbines 3 and the cover plate 9, the combustor 10 is completely assembled with stator assembly 11 up to bolts 12, and the combustor outer case 13 as a static outer engine housing assembly is completed up to the engine housing flange 14. With the left to right assembly of the engine completed to this stage, the engine is ready for the next step of installing the turbines 3 on the shaft assembly 4 and simultaneous assembly of the static turbine shroud 15 with a shroud flange 16 removably mounted to the engine housing flange 14.

As mentioned above, prior art assembly methods do not include the concentricity ring 1 nor the particular arrangement of the engine housing flange 14 and shroud flange 16. Prior art assembly of the static turbine shroud 15 to the high-pressure turbines 3 involves precise custom grinding of the static turbine shroud 15 to suit the blade tip surfaces of rotation for each engine configuration on assembly. Referring to FIG. 2, prior art systems of assembly include the mounting of turbine 3 on the shaft assembly 4 and measuring the eccentricity "e" for each engine assembly. The turbine shroud 15 as shown in FIG. 2 immediately radially adjacent the blade tips 8 includes a separate annular ring 17 which in prior art methods is initially prepared with an internal diameter less than the external diameter of the tip surface of rotation in order to accommodate the custom grinding operation. The internal surfaces of the annular ring 17 in the prior art is custom ground to match the eccentricity "e" and to maintain close blade tip gap tolerances. It will be appreciated as described above that this custom grinding operation severely delays the engine assembly operation and involves intensive highly skilled labour.

In contrast the present invention permits the annular ring 17 to be precisely machined on their interior surfaces to the desired configuration completely prior to the assembly operation. The eccentricity "e" between the engine axis 2 and assembled shaft axis 5 is accommodated by the use a concentricity ring 1 as will be explained below. Through use of the concentricity ring 1 custom grinding of the annular rings 17 and the accompanying delays in engine assembly and increased labour can be completely avoided. In accordance with the invention the static outer engine housing assembling 13 includes an engine housing flange 14 that has a cylindrical internal surface 18 concentric to the engine axis 2. The static turbine shroud 15 includes a shroud flange 16 with an external cylindrical surface 19. The shroud flange 16 is removably mounted to the engine housing flange 14 with bolts (not shown) through aligned bolt holes 20. The annular rings 17 comprising part of the static turbine shroud 15 have internal turbine shroud surfaces of rotation 21 matching the blade tip surface of rotation. A significant advantage of the invention is that the blade tip surface of rotation can be accurately determined by precise machining of the blade tips 8 and the internal turbine shroud surface of rotation 21 can be pre-manufactured to the precise configuration required to maintain blade tip gap at a desired level.

Radial adjustment for maintaining concentricity of the static turbine shroud 15 and turbines 3 is provided through the use of a concentricity ring 1 as follows. The concentricity ring 1 is precisely machined with an outer cylindrical surface mating the internal cylindrical surface 18 of the engine housing flange 20. The concentricity ring 1 has an eccentric inner cylindrical surface which mates the external cylindrical surface 19 of the turbine shroud flange 16.

The outer and inner cylindrical surfaces of the concentricity ring 1 are eccentric a ring eccentricity dimension within the range between 0 and the pre-determined allowable assembly tolerance. Therefore by positioning the concentricity ring 1 between the flange cylindrical surfaces 18 and 19 the radial position of the turbine shroud 15 can be adjusted to suit the corresponding radial position of the turbine 3 rotating above the shaft axis 5. The bolt holes 20 are oversized to accommodate for the outset positioning of the turbine shroud 15 as a result of the insertion of the concentricity ring 1. Alternatively the bolt holes 20 can be initially machined undersized and then are reamed on final assembly.

It will be understood that different engines will be assembled and result in eccentricity dimensions "e". The eccentricity present in the concentricity rings 1 applied to different engines may vary anywhere between 0 eccentricity and to a pre-determined allowable assembly tolerance, for example in the range of 5 to $^{10}/_{1000}{}^{th}$ of an inch. To accommodate the expected variance in the eccentricity dimension "e", the invention also includes a kit for engine assembly, with a number of concentricity rings, 1 wherein each ring of the kit has a different ring eccentricity. For example the engine assembly kit can include concentricity rings 1 of progressive equally stepped ring eccentricities beginning at 0 eccentricity and at each $^{1}/_{1000}{}^{th}$ of an inch to a maximum allowable assembly tolerance, of $^{10}/_{1000}{}^{th}$ of an inch for example.

In addition since the eccentricity of the concentricity ring 1 and the eccentricity of the high pressure turbines 3 must correspond, the rings 1 preferably include markings on a ring at various positions corresponding to the radial ring thickness at maximum ring thickness, minimum ring thickness and medium ring thickness for example. In this way the installer can correctly aligned the eccentricity of the concentricity ring 1 with the eccentricity of the engine shaft assembly 4 and turbines 3 mounted thereon.

Although the above description and accompanying in drawings relate to a specific preferred embodiment as presently contemplated by the inventors, it will be understood that the invention in its broad aspect includes mechanical and functional equivalents of the elements described and illustrated.

The embodiments of the invention in which an exclusive property or privilege is claimed are defined as follows:

1. In a gas turbine engine having:

a longitudinal engine axis; and at least one turbine disposed on a shaft assembly at a predetermined axial position for rotation about a longitudinal shaft axis, the turbine including a hub with a circumferentially spaced apart array of turbine blades each having a radially outward blade tip, the blade tips during turbine rotation defining a tip surface of rotation concentric the shaft axis;

the shaft axis being radially eccentric the engine axis at the axial position of the turbine an assembly eccentricity within the range between zero and a predetermined allowable assembly tolerance; the improvement comprising:

a static outer engine housing assembly having an engine housing flange with a cylindrical internal surface concentric the engine axis;

a static turbine shroud having a shroud flange with an external cylindrical surface removably mounted to the engine housing flange and having an internal turbine shroud surface of rotation matching the blade tip surface of rotation, the shroud external and internal surfaces being non-eccentric relative to one another; and a concentricity ring with: an outer cylindrical surface mating the internal cylindrical surface of the engine housing flange; and an inner cylindrical surface mating the external cylindrical surface of the turbine shroud flange; the outer and inner cylindrical surfaces of the concentricity ring being eccentric a ring eccentricity within the range between zero and said predetermined allowable assembly tolerance.

2. An engine assembly kit comprising a plurality of concentricity rings according to claim 1 wherein each ring of the kit has a different ring eccentricity.

3. An engine assembly kit according to claim 2 comprising concentricity rings of progressive equally stepped ring eccentricities.

4. A concentricity ring according to claim 1 including a marking on the ring at a position corresponding to a radial ring thickness selected from the group consisting of: a maximum ring thickness; a minimum ring thickness; and a median ring thickness.

5. A method of assembling a gas turbine engine having:

a longitudinal engine axis with at least one turbine disposed on a shaft assembly at a predetermined axial position for rotation about a longitudinal shaft axis, the turbine including a hub with a circumferentially spaced apart array of turbine blades each having a radially outward blade tip, the blade tips during turbine rotation defining a tip surface of rotation concentric the shaft axis; the shaft axis being radially eccentric the engine axis at the axial position of the turbine an assembly eccentricity within the range between zero and a predetermined allowable assembly tolerance; the engine further including:

a static outer engine housing assembly having an engine housing flange with a cylindrical internal surface concentric the engine axis; and a static turbine shroud having a shroud flange with an external cylindrical surface removably mounted to the engine housing flange and having an internal turbine shroud surface of rotation matching the blade tip surface of rotation, the shroud external and internal surfaces being non-eccentric relative to one another; the method of assembly comprising:

positioning a concentricity ring with: an outer cylindrical surface engaging the internal cylindrical surface of the engine housing flange; and an inner cylindrical surface engaging the external cylindrical surface of the turbine shroud flange;

the outer and inner cylindrical surfaces of the concentricity ring being eccentric a ring eccentricity within the range between zero and said predetermined allowable assembly tolerance.

6. A method according to claim 5 comprising the step of selecting a concentricity ring from a kit of like concentricity rings wherein each ring of the kit has a different ring eccentricity.

7. A method according to claim 6 wherein the kit includes eccentricity rings of progressive equally stepped ring eccentricities.

* * * * *